US006262013B1

(12) United States Patent
Smith et al.

(10) Patent No.: US 6,262,013 B1
(45) Date of Patent: Jul. 17, 2001

(54) SANITIZING LAUNDRY SOUR

(75) Inventors: Kim R. Smith, Woodbury, MN (US); Lynne A. Olson, Ellsworth, WI (US); Wendy M. Wiseth, St. Paul, MN (US); Robert D.P. Hei, Baldwin, WI (US); Paul J. Mattia, Prior Lake, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/419,726

(22) Filed: Oct. 15, 1999

Related U.S. Application Data

(60) Provisional application No. 60/115,815, filed on Jan. 14, 1999.

(51) Int. Cl.[7] ..... C11D 3/00; D06F 11/26

(52) U.S. Cl. ..... 510/529; 8/137

(58) Field of Search ..... 510/529; 8/137

(56) References Cited

U.S. PATENT DOCUMENTS

| | | |
|---|---|---|
| 2,220,099 | 11/1940 | Guenther et al. . |
| 2,477,383 | 7/1949 | Lewis . |
| 3,308,067 | 3/1967 | Diehl . |
| 3,749,673 | 7/1973 | Jones et al. . |
| 3,933,672 | 1/1976 | Bartolotta et al. . |
| 3,936,537 | 2/1976 | Baskerville, Jr. et al. . |
| 4,045,358 | 8/1977 | Ramachandran . |
| 4,136,045 | 1/1979 | Gault et al. . |
| 4,144,226 | 3/1979 | Crutchfield et al. . |
| 4,147,720 | 4/1979 | Berkowitz . |
| 4,220,562 | 9/1980 | Spadini et al. . |
| 4,222,905 | 9/1980 | Cockrell, Jr. . |
| 4,239,659 | 12/1980 | Murphy . |
| 4,246,495 | 1/1981 | Pressman . |
| 4,412,934 | 11/1983 | Chung et al. . |
| 4,483,781 | 11/1984 | Hartman . |
| 4,619,779 | 10/1986 | Hardy . |
| 4,634,551 | 1/1987 | Burns et al. . |
| 4,663,071 | 5/1987 | Bush et al. . |
| 4,704,212 | 11/1987 | Schindler et al. . |
| 4,909,953 | 3/1990 | Sadlowski et al. . |
| 5,112,514 | 5/1992 | Bolkan et al. . |
| 5,117,049 | 5/1992 | Venturello et al. . |
| 5,122,538 | 6/1992 | Lokkesmoe et al. . |
| 5,179,168 | 1/1993 | Hirasawa . |
| 5,205,835 | 4/1993 | Tieckelmann et al. . |
| 5,213,705 | 5/1993 | Olson . |
| 5,266,587 | 11/1993 | Sankey et al. . |
| 5,320,805 | 6/1994 | Kramer et al. . |
| 5,468,532 | 11/1995 | Ho et al. . |
| 5,567,444 | 10/1996 | Hei et al. . |
| 5,728,502 | 3/1998 | Ou-Yang et al. . |
| 5,747,443 | 5/1998 | Wahl et al. . |
| B1 4,663,071 | 4/1992 | Bush et al. . |

FOREIGN PATENT DOCUMENTS

| | | |
|---|---|---|
| DE 39 29 335 A1 | 3/1991 | (DE) . |
| 0 086 423 A2 | 8/1983 | (EP) . |
| 0 313 143 A2 | 4/1989 | (EP) . |
| 0 443 640 A2 | 8/1991 | (EP) . |
| 0 461 700 A1 | 12/1991 | (EP) . |
| WO 88/00795 | 2/1988 | (WO) . |
| WO 94/00548 | 1/1994 | (WO) . |

*Primary Examiner*—Mark Kopec
*Assistant Examiner*—John M Petruncio
(74) *Attorney, Agent, or Firm*—Merchant & Gould P.C.

(57) ABSTRACT

A sanitizing fabric sour composition can comprise a peracid material. The sanitizing sour materials of the invention can be used in a laundry process in which soiled garments are contacted with the sanitizing sour following an alkaline detergent in a cleaning step. In the souring step, the garments are contacted with the peracid material that both neutralizes alkaline components and sanitizes the cleaned garment. The fabric sour process of the invention can be conducted at reduced temperatures while obtaining sufficient sanitization.

25 Claims, No Drawings

SANITIZING LAUNDRY SOUR

CROSS-REFERENCE TO RELATED APPLICATIONS

This application claims priority from U.S. Provisional Patent Application Serial No. 60/115,815, filed Jan. 14, 1999.

FIELD OF THE INVENTION

The invention relates to laundry compositions and processes. In a laundry process, soiled garments are commonly contacted with an alkaline detergent for primary soil removal. Once soil is removed from the garments, the clean garments are often contacted with a laundry sour material. The invention relates to improved laundry sour compositions that provide other desirable properties to the cleaned garments.

BACKGROUND OF THE INVENTION

In typical commercial or industrial laundry processes, textile materials such as sheets, towels, wipes, garments, tablecloths, etc. are commonly laundered at elevated temperatures with alkaline detergent materials. Such detergent materials typically contain a source of alkalinity such as an alkali metal hydroxide, alkali metal silicate, alkali metal carbonate or other such base component. Additionally, such laundry chemicals typically contain anionic or other detergent materials that can enhance soil removal from the woven material. Such detergents also contain other components such as bleaches, brightening agents, antiredeposition agents, etc. that are used to enhance the appearance of the resulting cleaned article. Often the resulting cleaned items are then contacted with a commercial or industrial sour material. The residual components of the alkaline detergents remaining in or on the laundered item can result in fabric damage and skin irritation by the wearer of the washed fabric. This is particularly a problem with towels, sheets and garments. Sour materials contain acid components that neutralize alkaline residues on the fabric.

An important long felt need in laundry processing is the goal of obtaining cleaned and sanitized laundry items. A substantial reduction of bacteria, fungi, spores and other microorganisms or microorganism generating materials is important particularly in the medical, food processing and hospital industries. The substantial reduction in (more than five orders of magnitude, a five-$\log_{10}$ reduction) microorganisms is considered to be a sanitizing result. Laundry chemicals in laundry processes have long been sought that can provide sanitizing of laundered items without the use of strong, corrosive or otherwise dangerous or unpleasant chemicals. Presently, chemicals that have been used in the art include quaternary ammonium compounds, strong chlorine based sanitizers, and other strong chemicals. Such materials often result in forming laundered items that can provide skin irritation. The cleaning materials can be offensive or irritating in odor or inhalation toxicity, can have a deleterious effect on fabric or institutional laundry equipment, can be chemically unstable, expensive, etc.

Examples of laundry chemical detergent additives are shown in the art. Spadini et al., U.S. Pat. No. 4,220,562, disclose a peracid bleaching material adapted for stain removal containing an organic peroxy compound, an alkoxylated nonionic surfactant and other materials useful in stain removal. Spadini et al. suggest that a variety of conventional laundry components can be combined with the disclosed materials.

Hardy, U.S. Pat. No. 4,619,779, discloses a detergent additive product comprising a $C_5$–$C_{18}$ aliphatic peroxycarboxylic acid bleach precursor. The bleach material typically includes the peracid bleach precursor combined with a flexible substrate. The bleach precursor can also be used with activators, detergents and other conventional laundry chemicals.

Trabitzsch, DE 3929335, discloses peroxy salts and peroxy generating compounds as well known detergent additive compositions that can be incorporated into laundry chemical compositions to use the peroxy function as a bleaching material. Trabitzsch suggests that these peracid materials are effective bleaches, but fail to emphasize that these materials can be used in a laundry step after the alkaline detergent in a stage that sanitizes, softens and neutralizes alkaline residues.

Kramer et al., U.S. Pat. No. 5,320,805, disclose methods of using laundry chemicals as a cleaner, sanitizer, disinfectant, sporicide, fungicide and sterilizer using an alkaline water soluble salt comprising hydrogen peroxide and phosphonium, sulfonium, quaternary ammonium or other such salts in a liquid soluble phase transfer material. The Kramer et al. technology involves interaction between a peroxy material such a perborate, persilicate, persulfate, peracetate or perphosphate and a quaternary ammonium material in a laundry detergent composition. The compositions of the invention are exemplified as containing a sodium carbonate peroxide material combined with a conventional quaternary ammonium compound and a EO-PO block copolymer.

Tieckelmann et al., U.S. Pat. No. 5,205,835 teaches a process for removing manganese dioxide residue from wet processed denim garments by neutralizing the alkaline fabric character with peracetic acid neutralizing agent. This patent is directed to permanganate bleached denim. The removal of the permanganate residue from the treated denim is a common problem in denim processing that is not typical in conventional, commercial or institutional laundry processes. Typically, laundry items contain no permanganate since they are used items and not permanganate processed prior to initiating laundry processing. Accordingly, the laundry items and the processes of the invention are typically permanganate free.

A long felt need in this industry has existed for effective laundry chemicals and processes that are highly effective in soil removal, fabric sanitization and sour soft properties. Such materials should remove oily and greasy soils, kill or substantially reduce the populations of bacteria, fungi, viruses and other harmful or illness causing pathogens. Lastly, the laundered material should be rendered soft and compatible with human contact. In use, the compositions of the present invention can be used in a single step following an alkaline laundry detergent step to improve the character and quality of the laundered product by providing both softness and sanitizing.

BRIEF DISCUSSION OF THE INVENTION

The laundry chemical compositions and laundry processes of the invention provide for the use of a fabric sanitizing/sour material that can be used in laundry processes following an alkaline detergent. In the processes of the invention, the fabric items can be contacted with an alkaline detergent material for the purpose of loosening and removing soil from the fabric to produce a treated item. The treated items are then contacted in a subsequent step with an oxidant peracid material that typically includes an organic acid, hydrogen peroxide and the resulting peracid material.

Accordingly, the invention is found in a laundry process that can provide cleaned, sanitized and neutralized laundry items, the process including contacting soiled laundry items with an alkaline detergent to form a treated laundry item, and contacting the treated laundry item with a peracid composition including hydrogen peroxide, an organic carboxylic acid, and a resulting organic peracid, wherein the composition is capable of pH neutralizing and sanitizing the laundry item.

The invention is also found in a laundry process, substantially free of a permanganate component, that can clean, sanitize and neutralize laundry items, the process including contacting a soiled laundry item with an aqueous alkaline detergent containing an aqueous laundry detergent surfactant and a source of alkalinity and builder with a soiled laundry item to remove soil to produce a treated laundry item, and contacting the treated laundry item with an aqueous peracid composition per pound of laundry item, said peracid composition containing hydrogen peroxide, an organic acid and the resulting organic peracid.

The invention is also found in a process for neutralizing and sanitizing laundry items which have been cleaned with an alkaline detergent. This process includes contacting the cleaned item with the above described peracid composition.

Such laundry chemicals and processes can provide cleaned, sanitized and neutralized laundry items at temperatures which are typically considered ineffective for laundry sanitization processes. These processes can be run at a temperature of less than 70° C., preferably less than about 50° C. and are often conducted at a pH between 4 and 9, preferably between 5 and 7.

DETAILED DISCUSSION OF THE INVENTION

The invention is found in a laundry process that can provide cleaned, sanitized and neutralized laundry items, the process including contacting soiled laundry items with an alkaline detergent to form a treated laundry item, and contacting the treated laundry item with a peracid composition including hydrogen peroxide, an organic carboxylic acid, and a resulting organic peracid, wherein the composition is capable of neutralizing and sanitizing the laundry item. The peracid composition is capable of simultaneously neutralizing and sanitizing the laundry items, thereby eliminating the need for costly, time delaying separate souring and sanitizing steps.

While the peracid composition could be used in any laundry equipment, the process of the invention is preferably carried out in an automated laundry machine. After washing the laundry items in a conventional wash step or cycle, the laundry items are treated with the peracid composition of the invention. After this neutralizing and sanitizing step or cycle, the laundry items can be further processed, e.g. an extraction step to remove residual water, an optional softening step, followed by a drying step or one or more rinse cycles and drying. This drying step is typically carried out in a rotating drum which is exposed to a source of heat, typically a gas flame or electrical heating element.

The peracid treatment step does not require high temperatures to be effective. The treated laundry item can be contacted with the peracid composition in a machine cycle at a temperature less than about 70° C., preferably less than about 50° C. Typically, the peracid composition is used in a machine cycle at a pH between about 4 and 9, preferably between about 5 and 7.

A. The Sanitizing Composition

The sanitizing composition used in the method of the invention generally contains one or more carboxylic acids and one or more peroxycarboxylic acids with a peroxygen compound such as hydrogen peroxide, $H_2O_2$. Typically, however, the composition contains one or more carboxylic acids, an oxidizer, and one or more peroxycarboxylic acids depending on equilibrium. Commonly, the peroxycarboxylic acid material can be made by oxidizing a carboxylic acid directly to the peroxycarboxylic acid material which is then solubilized in the aqueous rinse compositions of the invention. Further, the materials can be made by combining the unoxidized acid with a peroxygen compound such as hydrogen peroxide to generate the peracid in situ prior to blending the peroxycarboxylic acid with other constituents. This is described in U.S. Pat. No. 5,122,538, incorporated by reference herein. The resulting solution can have the following constitution:

| Component | Useful | Preferred | More Preferred |
|---|---|---|---|
| carboxylic acid | 1–80 | 20–60 | 20–40 |
| peroxycarboxylic acid | 1–50 | 5–30 | 10–20 |
| oxidizer | 1–50 | 5–30 | 5–15 |

A carboxylic acid is an organic acid (R—COOH) which contains an aliphatic group and one or more carboxyl groups. A carboxyl group is represented by —COOH, and is usually located at a terminal end of the acid. The aliphatic group can be a substituted or unsubstituted group. Common aliphatic substituents may include —OH, —OR, —$NO_2$, halogen, and other substituents common on these groups. An example of a simple carboxylic acid is acetic acid, which has the formula $CH_3COOH$. A peroxycarboxylic acid is a carboxylic acid which has been oxidized to contain a terminal —COOOH group. The term peroxy acid is often used to represent a peroxycarboxylic acid. An example of a simple peroxy acid is peroxyacetic acid, which has the formula $CH_3COOOH$.

Generally when the peroxycarboxylic acid is formulated in accordance with the invention a monocarboxylic acid, such as acetic acid, is combined with an oxidizer such as hydrogen peroxide. The result of this combination is a reaction producing a peroxycarboxylic acid, such as peroxyacetic acid, and water. The reaction follows an equilibrium in accordance with the following equation:

$$H_2O_2+CH_3COOH=CH_3COOOH+H_2O$$

wherein the $pK_{eq}$ is 1.7.

The importance of the equilibrium results from the presence of hydrogen peroxide, the carboxylic acid and the peroxycarboxylic acid in the same composition at the same time. Because of this equilibrium, a mixture of carboxylic acid and peroxycarboxylic acid can be combined in water without adding hydrogen peroxide. If permitted to approach equilibrium, the mixture will evolve hydrogen peroxide. This combination provides enhanced sanitizing with none of the deleterious environmental or organoleptic effects of other sanitizing agents, additives, or compositions.

The Carboxlic Acid

Carboxylic acids have the formula R—COOH wherein the R may represent any number of different groups including aliphatic groups, alicyclic groups, aromatic groups, heterocyclic groups, all of which may be saturated or unsaturated. Carboxylic acids also occur having one, two, three, or more carboxyl groups. Aliphatic groups can be further differentiated into three distinct classes of hydrocarbons. Alkanes (or paraffins) are saturated hydrocarbons. Alkenes (or olefins) are unsaturated hydrocarbons which contain one or more double bonds and alkynes (or acetylenes) are unsaturated hydrocarbons containing one or more highly reactive triple bonds.

Alicyclic groups can be further differentiated into three distinct classes of cyclic hydrocarbons. Cycloparaffins are saturated cyclic hydrocarbons. Cycloolefins are unsaturated cyclic hydrocarbons which contain one or more double bonds while cycloacetylenes are unsaturated cyclic hydrocarbons containing one or more highly reactive triple bonds. Aromatic groups are defined as possessing the unsaturated hydrocarbon ring structure representative of benzene. Heterocyclic groups are defined as 5 or 6 member ring structures wherein one or more of the ring atoms are not carbon. An example is pyridine, which is essentially a benzene ring with one carbon atom replaced with a nitrogen atom.

Carboxylic acids have a tendency to acidify aqueous compositions in which they are present as the hydrogen atom of the carboxyl group is active and may appear as a cation. The carboxylic acid constituent within the present composition when combined with aqueous hydrogen peroxide generally functions as an antimicrobial agent as a result of the presence of the active hydrogen atom. Moreover, the carboxylic acid constituent within the invention maintains the composition at an acidic pH. The composition of the invention can utilize carboxylic acids containing as many as 10 carbon atoms. Examples of suitable carboxylic acids include formic, acetic, propionic, butanoic, pentanoic, hexanoic, heptanoic, octanoic, nonanoic, decanoic, lactic, maleic, ascorbic, citric, hydroxyacetic, neopentanoic, neoheptanoic, oxalic, malonic, succinic, glutaric, adipic, pimelic and subric acid.

Carboxylic acids which are generally useful are those having one or two carboxyl groups where the R group is a primary alkyl chain having a length of $C_2$ to $C_{10}$, preferably $C_2$ to $C_5$ and which are freely water soluble. The primary alkyl chain is that carbon chain of the molecule having the greatest length of carbon atoms and directly appending carboxyl functional groups. Especially useful are mono- and dihydroxy substituted carboxylic acids including alpha-hydroxy substituted carboxylic acid. A preferred carboxylic acid is acetic acid, which produces peroxyacetic acid to increase the sanitizing effectiveness of the materials. Acetic acid has the structure of the formula:

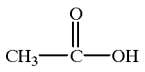

Generally, the concentration of carboxylic acid within the composition used in the process of the invention ranges from about 1 wt-% to about 80 wt-%, preferably from about 20 wt-% to about 60 wt-%, and most preferably from about 20 wt-% to about 40 wt-%.

The Peroxycarboxylic Acid

Another principle component of the antimicrobial composition of the invention is an oxidized carboxylic acid. This oxidized or peroxycarboxylic acid provides heightened antimicrobial efficacy when combined with hydrogen peroxide and the monocarboxylic acid in an equilibrium reaction mixture. Peroxycarboxylic acids generally have the formula $R(CO_3H)_n$, where R is an alkyl, arylalkyl, cycloalkyl, aromatic or heterocyclic group, and n is one or two and named by prefixing the parent acid with peroxy. An alkyl group is a paraffinic hydrocarbon group which is derived from an alkane by removing one hydrogen from the formula. The hydrocarbon group may be either linear or branched, having up to 9 carbon atoms. Simple examples include methyl ($CH_3$) and ethyl ($CH_2CH_3$). An arylalkyl group contains both aliphatic and aromatic structures. A cycloalkyl group is defined as a cyclic alkyl group.

While peroxycarboxylic acids are not very stable, their stability generally increases with increasing molecular weight. Thermal decomposition of these acids may generally proceed by free radical and nonradical paths, by photodecomposition or radical-induced decomposition, or by the action of metal ions or complexes. Peroxycarboxylic acids may be made by the direct, acid catalyzed equilibrium action of 30–98 wt-% hydrogen peroxide with the carboxylic acid, by autoxidation of aldehydes, or from acid chlorides, acid anhydrides, or carboxylic anhydrides with hydrogen or sodium peroxide.

Peroxycarboxylic acids useful in this invention include peroxyformic, peroxyacetic, peroxypropionic, peroxybutanoic, peroxypentanoic, peroxyhexanoic, peroxyheptanoic, peroxyoctanoic, peroxynonanoic, peroxydecanoic, peroxylactic, peroxymaleic, peroxyascorbic, peroxyhydroxyacetic, peroxyoxalic, peroxymalonic, peroxysuccinic, peroxyglutaric, peroxyadipic, peroxypimelic and peroxysubric acid and mixtures thereof. These peroxycarboxylic acids have been found to provide good antimicrobial action with good stability in aqueous streams.

Peroxyacetic acid is a peroxycarboxylic acid with a structure as given the formula:

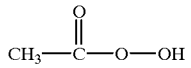

wherein the peroxy group, —O—O—, is considered a high energy bond. Generally, peroxyacetic acid is a liquid having an acrid odor and is freely soluble in water, alcohol, ether, and sulfuric acid. Peroxyacetic acid may be prepared through any number of means known to those of skill in the art including preparation from acetaldehyde and oxygen in the presence of cobalt acetate. A 50% solution of peroxyacetic acid may be obtained by combining acetic anhydride, hydrogen peroxide and sulfuric acid.

The above sanitizer material can provide antibacterial activity to the rinse aid sanitizers of the invention against a wide variety of microorganisms such as gram positive (for example, *Staphylococcus aureus*) and gram negative (for example, *Escherichia coli*) microorganisms, yeast, molds, bacterial spores, viruses, etc. When combined, the above peroxy acids can have enhanced activity compared to the low molecular weight peroxy acids alone.

Generally, the concentration of peroxycarboxylic acid within the composition used in the process of the invention ranges from about 1 wt-% to about 50 wt-%, preferably from about 5 wt-% to about 30 wt-%, and most preferably from about 10 wt-% to about 20 wt-%.

The Oxidizer

The composition used in the method of the invention also includes an oxidizer. Any number of oxidizers may be used as a precursor to the formation of a peroxycarboxylic acid as well as to provide further physical effervescent or agitation action to the composition of the invention. Preferably, the antimicrobial composition of the invention contains hydrogen peroxide. Hydrogen peroxide ($H_2O_2$) has a molecular weight of 34.014 and it is a weakly acidic, clear, colorless liquid. The four atoms are covalently bonded in a non-polar structure:

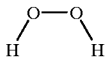

Generally, hydrogen peroxide has a melting point of −0.41° C., a boiling point of 150.2° C., a density at 25° C. of 1.4425 grams per $cm^3$, and a viscosity of 1.245 centipoise at 20° C.

Hydrogen peroxide in combination with the carboxylic acid and peroxycarboxylic acid provides a surprising level of antimicrobial action against microorganisms, even in the presence of high loadings of organic sediment. Additionally, hydrogen peroxide provides an effervescent action which may irrigate any surface to which it is applied. Hydrogen peroxide works with a mechanical flushing action once applied which further plains the surface of application. An additional advantage of hydrogen peroxide is the food compatibility of this composition upon use and decomposition. For example, combinations of peroxyacetic acid and hydrogen peroxide result in acetic acid, water, and oxygen upon decomposition. All of these constituents are food product compatible.

Concentrations of hydrogen peroxide may be increased or decreased while still remaining within the scope of the present invention. For example, increasing the concentration of hydrogen peroxide may increase the antimicrobial efficacy of the claimed invention. Furthermore, increasing the hydrogen peroxide concentration may reduce the need to stabilize the hydrogen peroxide within the composition. Specifically, increasing the hydrogen peroxide concentration in the composition may provide a composition which has extended shelf life.

In contrast, decreasing the concentration of hydrogen peroxide may decrease the antimicrobial efficacy of the composition and necessitate the use of an increased concentration of carboxylic acid. Moreover, decreasing the concentration of hydrogen peroxide may necessitate the use of some stabilizing agent to ensure that the composition of the present invention will remain stable and efficacious over the intended time period.

Generally, the concentration of hydrogen peroxide within the composition used in the process of the invention ranges from about 1 wt-% to about 50 wt-%, preferably from about 5 wt-% to about 30 wt-%, and most preferably from about 5 wt-% to about 15 wt-%.

Conventional Detergent Compositions

The processes of the invention utilize a conventional detergent composition after the initial pretreatment step. Conventional detergent compositions include surfactants, builders or sequestrants and minor ingredients.

Surfactants

Useful anionic surfactants include the water soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12}$–$C_{18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration, e.g., see U.S. Pat. Nos. 2,220,099 and 2,477,383. Especially valuable are linear straight chain alkylbenzene sulfonates in which the average number of carbon atoms in the alkyl group is from about 11 to 14,abbreviated as $C_{11-14}$ LAS. Also, preferred are mixtures of $C_{10-16}$ (preferably $C_{11-13}$) linear alkylbenzene sulfonates and $C_{12-18}$ (preferably $C_{14-16}$) alkyl sulfates, alkyl ether sulfates, alcohol ethoxylate sulfates, etc.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water soluble salts of esters of alpha-sulfonated fatty acids containing from about 6 to 20 carbon atoms in the fatty acid group and from about 1 to 10 carbon atoms in the ester group; water soluble salts of 2-acyloxyalkane-1-sulfonic acids containing from about 2 to 9 carbon atoms in the acyl group and from about 9 to about 23 carbon atoms in the alkane moiety; water soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Also useful are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counterions) associated with these polar groups, sodium, lithium and potassium impart water solubility and are most preferred in compositions of the present invention.

Examples of suitable synthetic, water soluble anionic compounds are the alkali metal (such as sodium, lithium and potassium) salts or the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl naphthalene sulfonate, dialkyl naphthalene sulfonate and alkoxylated derivatives. Other anionic detergents are the olefin sulfonates, including long chain alkene sulfonates, long chain hydroxyalkane sulfonates or mixtures of alkenesulfonates and hydroxyalkane-sulfonates and alkylpoly (ethyleneoxy) ether sulfonates. Also included are the alkyl sulfates, alkyl poly (ethyleneoxy) ether sulfates and aromatic poly (ethyleneoxy) sulfates such as the sulfates or condensation products of ethylene oxide and nonyl phenol (usually having 1 to 6 oxyethylene groups per molecule).

Water soluble nonionic surfactants are also useful in the instant detergent granules. Such nonionic materials include compounds produced by the condensation of alkylene oxide groups (hydrophilic in nature) with an organic hydrophobic group or compound, which may be aliphatic or alkyl in nature. The length of the polyoxyalkylene group which is condensed with any particular hydrophobic group can be readily adjusted to yield a water soluble compound having the desired degree of balance between hydrophilic and hydrophobic elements.

Included are the water soluble and water dispersible condensation products of aliphatic alcohols containing from 8 to 22 carbon atoms, in either straight chain or branched configuration, with from 3 to 12 moles of ethylene oxide per mole of alcohol. Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkylene oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Useful nonionic surfactants include block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade name PLURONIC® manufactured by BASF Corp. PLURONIC® compounds are difunctional (two reactive hydrogens) compounds formed by condensing ethylene oxide with a hydrophobic base formed by the addition of propylene oxide to two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule. TETRONIC® compounds are tetra-functional block copolymers derived from the sequential additional of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Also useful nonionic surfactants include the condensation products of one mole of alkyl phenol wherein the alkyl constituent, contains from about 8 to about 18 carbon atoms with from about 3 to about 50 moles of ethylene oxide. The alkyl group can, for example, be represented by diisobutylene, di-amyl, polymerized propylene, isoctyl, nonyl, and di-nonyl. Examples of commercial compounds of this chemistry are available on the market under the trade name IGEPAL® manufactured by Rhone-Poulenc and TRITON® manufactured by Union Carbide.

Likewise useful nonionic surfactants include condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactants are available under the trade name NEODOL® manufactured by Shell Chemical Co. and ALFONIC® manufactured by Vista Chemical Co. A preferred class of nonionic surfactants are nonyl phenol ethoxylates, or NPE.

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above delineated carbon atoms range or it can consist of an acid having a specific number of carbon atoms within the range. Examples of commercial compounds of this chemistry are available on the market under the trade name NOPALCOL® manufactured by Henkel Corporation and LIPOPEG® manufactured by Lipo Chemicals, Inc. In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances.

Tertiary amine oxides corresponding to the general formula:

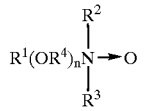

can be used wherein the→bond is a conventional representation of a semi-polar bond; and $R^1$, $R^2$, and $R^3$ may be aliphatic, aromatic, heterocyclic, alicyclic groups or a combination of such groups thereof. Generally, for amine oxides of detergent interest, $R^1$ is an alkyl radical of from about 8 to about 24 carbon atoms; $R^2$ and $R^3$ are selected from the group consisting of alkyl or hydroxyalkyl of 1–3 carbon atoms and mixtures thereof; $R^4$ is an alkylene or a hydroxyalkylene group containing 2 to 3 carbon atoms; and n ranges from 0 to about 20. Useful water soluble amine oxide surfactants are selected from the coconut or tallow dimethyl amine oxides.

Semi-polar nonionic surfactants include water soluble amine oxides containing one alkyl moiety of from about 10 to 18 carbon atoms and two moieties selected from the group of alkyl and hydroxyalkyl moieties of from about 1 to about 3 carbon atoms; water soluble phosphine oxides containing one alkyl moiety of about 10 to 18 carbon atoms and two moieties selected from the group consisting of alkyl groups and hydroxyalkyl groups containing from about 1 to 3 carbon atoms; and water soluble sulfoxides containing one alkyl moiety of from about 10 to 18 carbon atoms and a moiety selected from the group consisting of alkyl and hydroxylalkyl moieties of from about 1 to 3 carbon atoms. Nonionic surfactants are of the formula $R^1(OC_2H_4)_nOH$, wherein $R^1$ is a $C_6$–$C_{16}$ alkyl group and n is from 3 to about 80 can be used. Condensation products of $C_6$–$C_{15}$ alcohols with from about 5 to about 20 moles of ethylene oxide per mole of alcohol, e.g., $C_{12}$–$C_{14}$ alcohol condensed with about 6.5 moles of ethylene oxide per mole of alcohol.

Amphoteric surfactants include derivatives of aliphatic or aliphatic derivatives of heterocyclic secondary and tertiary amines in which the aliphatic moiety can be straight chain or branched and wherein one of the aliphatic substituents contain from about 8 to 18 carbon atoms and at least one aliphatic substituent contains an anionic water solubilizing group.

Cationic surfactants can also be included in the present detergent granules. Cationic surfactants include a wide variety of compounds characterized by one or more organic hydrophobic groups in the cation and generally by a quaternary nitrogen associated with an acid radical. Pentavalent nitrogen ring compounds are also considered quaternary nitrogen compounds. Halides, methyl sulfate and hydroxide are suitable. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both incorporated herein by reference.

Alkalinity Source

A source of alkalinity is needed to control the pH of the use detergent solution. The alkalinity source is selected from the group consisting of alkali metal hydroxide, such a sodium hydroxide, potassium hydroxide or mixtures thereof; an alkali metal silicate such as sodium metasilicate may also be used. The preferred source, which is the most cost-effective, is commercially available sodium hydroxide which can be obtained in aqueous solutions in a concentration of about 50 wt-% and in a variety of solid forms in varying particle sizes. The sodium hydroxide can be employed in the invention in either liquid or solid form or a mixture of both. Other sources of alkalinity are useful but not limited to the following: alkali metal carbonates, alkali metal bicarbonates, alkali metal sesquicarbonates, alkali metal borates and alkali metal silicate. The carbonate and borate forms are typically used in place of the alkali metal hydroxide when a lower pH is desired.

Other Ingredients

Other ingredients suitable for inclusion in a granular laundry detergent, such as a bleach or other additives can be added to the present compositions. These include detergency builders, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. Such ingredients are described in U.S. Pat. No. 3,936,537, incorporated herein by reference.

Builders (or sequestrants) are employed to sequester hardness ions and to help adjust the pH of the laundering liquor. Such builders can be employed in concentrations up to about 85% by weight, preferably from about 0.5% to about 50% by weight, most preferably from about 10% to about 30% by weight, of the compositions herein to provide their builder and pH-controlling functions. The builders herein include any of the conventional inorganic and organic water soluble builder salts. Such builders can be, for example, water soluble salts of phosphates including tripolyphosphates, pyrophosphates, orthophosphates, higher polyphosphates, other carbonates, silicates, and organic polycarboxylates. Specific preferred examples of inorganic phosphate builders include sodium and potassium tripolyphosphates and pyrophosphates. Nonphosphorus-containing materials can also be selected for use herein as builders.

Specific examples of nonphosphorus, inorganic detergent builder ingredients include water soluble bicarbonate, and silicate salts the alkali metal, e.g., sodium and potassium, bicarbonates, and silicates are particularly useful herein.

Water soluble, organic builders are also useful herein. For example, the alkali metal, polycarboxylates are useful in the present compositions. Specific examples of the polycarboxylate builder salts include sodium and potassium salts of ethylenediaminetetraacetic acid, nitrilotriacetic acid, oxydisuccinic acid, mellitic acid, benzene polycarboxylic acid, polyacrylic acid, and polymaleic acid.

Other desirable polycarboxylate builders are the builders set forth in U.S. Pat. No. 3,308,067, incorporated herein by reference. Examples of such materials include the water soluble salts of homo- and copolymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226 and U.S. Pat. No. 4,246,495, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization alkaline solution, converted to the corresponding salt, and added to a surfactant.

Bleaching agents and activators useful herein are also described in U.S. Pat. No. 4,412,934, U.S. Pat. No. 4,483,781, U.S. Pat. No. 4,634,551, and U.S. Pat. No. 4,909,953, all of which are incorporated herein by reference. Chelating agents are also described in U.S. Pat. No. 4,663,071, incorporated herein by reference. Suds modifiers are also optional ingredients and are described in U.S. Pat. Nos. 3,933,672, and 4,136,045, both incorporated herein by reference.

Encapsulate Active Oxidant Bleach

The detergent of the invention can comprise an encapsulated source of active halogen oxidant bleach. Preferred encapsulates are disclosed in U.S. Pat. No. 5,213,705.

The source of active halogen used in the continuous phase of the solid tablet of the invention and used in the core of the encapsulated source of halogen can comprise a halogen releasing substance suitable to liberate oxidizing active halogen species such as free elemental halogen (Cl., Br., $Cl_2$, $Br_2$) or —$OCl^-$ or —$OBr^-$, under conditions normally used in detergent bleaching cleaning processes of a variety of cleaning targets. Preferably the halogen releasing compound releases chlorine or bromine species. The most preferred halogen species is chlorine. Chlorine releasing compounds include potassium dichloroisocyanurate, sodium dichloroisocyanurate, chlorinated trisodium phosphate, calcium hypochlorite, lithium hypochlorite, monochloramine, dichloramine, [(monotrichloro)-tetra(monopotassium dichloro)]pentaisocyanurate, 1,3-dichloro-5,5-dimethylidantonone, paratoluene sulfodichloro-amide, trichloromelamine, N-chloramine, N-chlorosuccinimide, N,N'-dichloroazodicarbonamide, N-chloroacetyl-urea, chlorinated dicyandiamide, trichlorocyanuric acid, dichloroglycourea, etc. Chlorinated isocyanurate materials including sodium dichloroisocyanurate dehydrate, sodium dichloroisocyanurate, potassium dichloroisocyanurate, etc. are preferred chlorine sources suitable for the continuous solid phase and for the core substance of the encapsulated material. Chlorinated isocyanurates are commercially available from Monsanto or Olin and other vendors.

Encapsulated chlorine sources of the invention comprise a chlorine source core and at least one encapsulating layer. The encapsulating layer can comprise an inorganic material or an organic material or both in a layer or layers. Further, the core chlorine source can be covered with two, three or more useful organic or inorganic layers. Preferably we have found a two layer coating scheme wherein the core is coated with an inner inorganic layer and an outer organic layer comprising a material (detergent, sequestrant, builder, antiredeposition agent, etc.) useful in washing liquors. For the purposes of this application the term "encapsulating agent", as used herein encompasses solid soluble inorganic compounds used as inert fillers in detergent compositions and soluble inorganic builders used in detergent compositions which contribute to the detergency of the composition and which do not substantially react with a halogen bleach. The external organic phase of the encapsulate can comprise a variety of encapsulating materials that can be selected from small molecule, monomeric or polymeric sources.

The following examples are intended to illustrate the invention but are not to be construed as limiting the invention.

WORKING EXAMPLES

The "Test Substance" referred to below and in the table was prepared by mixing the following composition:

| | Wt-% |
|---|---|
| Acetic acid | 31 |
| Hydrogen peroxide | 11 |
| Peracetic acid | 15 |
| Water | 43 |

Oxy-15 Laundry Sanitizing Efficacy Test

Efficacy Test Operating Procedure

Fabric swatches inoculated with bacteria were wound around a stainless steel spindle and placed in the exposure chamber. 75.0 mL of each test substance batch use-solution was dispensed into the sterile exposure chambers. The exposure chamber was secured in the Launderometer and agitated for 5 minutes at 90±5° C. One mL of each use solution was placed into neutralizer after the 5 minute exposure time. Test swatches were then aseptically removed from the exposure chamber, placed into 1% sodium thiosulfate neutralizer and vortexed. Serial dilutions were performed in phosphate buffered dilution water. Plates were inverted and incubated at 37±2° C. for 48 hours.

The initial laundry water count was obtained by placing a dried fabric swatch into the fabric wound stainless steel spindle. This was prepared in triplicate. The fabric and spindle were placed into the exposure chamber and 75 mL sterile water was added. The exposure chamber was secured in the Launderometer and run for the 5 minute exposure time. Serial dilutions were performed on the water sample after the 5 minutes exposure time. Pour plate technique was employed. Plates were inverted and incubated at the 37±2° C. for 48 hours.

Methicillin-resistant *Staphylococcus aureus* ATCC 33592

| Test Substance Batch Number | CFU/mL Survivors | Average CFU/mL | Percent Reduction |
|---|---|---|---|
| 1 | <10, <10, <10 | <10 | >99.9 |
| 2 | <10, <10, $1 \times 10^1$ | $1.0 \times 10^1$ | >99.9 |
| 3 | <10, <10, <10 | <10 | >99.9 |

Percent Reduction = (Inoculum Numbers Average CFU/mL)-Average CFU/mL or Results) × 100

The above specification, examples and data provide a complete description of the manufacture and use of the composition of the invention. Since many embodiments of the invention can be made without departing from the spirit and scope of the invention, the invention resides in the claims hereinafter appended.

We claim:

1. A laundry process that provides cleaned, sanitized and pH neutralized laundry items, the process comprising:

(a) contacting soiled laundry items with an alkaline detergent to form a treated laundry item; and (b) contacting the treated laundry item with a peracid composition comprising hydrogen peroxide, an organic carboxylic acid, and a resulting organic peracid, wherein said composition neutralizes and sanitizes the laundry item.

2. The process of claim 1 wherein step (b) is carried out at a temperature less than about 70° C.

3. The process of claim 1 wherein step (b) is carried out at a temperature less than about 50° C.

4. The process of claim 1 wherein step (b) is carried out at a pH of between about 4 and 9.

5. The process of claim 1 wherein step (b) is carried out at a pH of between about 5 and 7.

6. The process of claim 1, wherein the peracid is a $C_2$ to $C_{10}$ peroxycarboxylic acid.

7. The process of claim 6, wherein the peracid is a $C_2$ to $C_5$ peroxycarboxylic acid.

8. The process of claim 7, wherein the peracid is selected from the group consisting of peracetic acid, perpropionic acid, peroctanoic acid, perdecanoic acid, and a mixture thereof.

9. The process of claim 1, wherein the peracid is peroxyacetic acid.

10. The process of claim 1, wherein the alkaline detergent comprises a source of alkalinity and a surfactant.

11. The process of claim 1 wherein the alkaline detergent comprises a source of alkalinity, a surfactant and a builder salt.

12. The process of claim 1, wherein the peracid composition comprises at equilibrium:

(a) about 1 to 50 wt-% hydrogen peroxide;

(b) about 1 to 80 wt-% of a $C_2$ to $C_{10}$ carboxylic acid, and (c) about 1 to 50 wt-% of a resulting $C_2$ to $C_{10}$ peroxycarboxylic acid.

13. The process of claim 12, wherein the carboxylic acid is selected from the group consisting of acetic acid, propionic acid, octanoic acid, decanoic acid, and a mixture thereof.

14. The process of claim 12, wherein the carboxylic acid is acetic acid.

15. A laundry process, substantially free of a permanganate component, that cleans and sanitizes laundry items, the process comprising:

(a) contacting a soiled laundry item with about 1 to 300 ounces of a laundry detergent chemical per hundred pounds of fabric laundry item, said laundry detergent comprising a source of alkalinity, and an anionic or nonionic surfactant in an aqueous medium, to remove soil to produce a treated laundry item; and (b) contacting the treated laundry item with about 1 to 10 ounces of an aqueous peracid composition per hundred pounds of laundry item, said peracid composition comprising hydrogen peroxide, an organic acid and the resulting organic peracid.

16. The process of claim 15, said process being carried out in an automated laundry machine.

17. The process of claim 16, wherein the treated laundry item is contacted with the peracid composition in a machine cycle at a temperature less than about 70° C.

18. The process of claim 16, wherein the treated laundry item is contacted with the peracid composition in a machine cycle at a temperature of less than about 50° C.

19. The process of claim 16, wherein the treated laundry item is contacted with the peracid composition in a machine cycle at a pH between about 4 and 9.

20. The process of claim 16, wherein the treated laundry item is contacted with the peracid composition in a machine cycle at a pH between about 5 and 7.

21. The process of claim 15, wherein the peracid is a $C_2$ to $C_{10}$ peroxycarboxylic acid.

22. The process of claim 15, wherein the peracid is a $C_2$ to $C_5$ peroxycarboxylic acid.

23. The process of claim 15, wherein the peracid is peroxyacetic acid.

24. A process for sanitizing and softening a laundry item treated with an alkaline detergent comprising contacting the treated laundry items with a peracid composition comprising hydrogen peroxide, an organic carboxylic acid, and a resulting organic peracid.

25. The process of claim 24, wherein the treated laundry item is contacted with about 1 to 10 ounces of an aqueous peracid composition per hundred pounds of laundry item, said peracid composition comprising hydrogen peroxide, an organic acid and the resulting organic peracid.

* * * * *